US006863506B2

(12) United States Patent
Park et al.

(10) Patent No.: US 6,863,506 B2
(45) Date of Patent: Mar. 8, 2005

(54) RECIPROCATING COMPRESSOR

(75) Inventors: Kyeong-Bae Park, Seoul (KR); Jong-Tae Heo, Bucheon (KR); Ki-Won Noh, Seoul (KR); Jae-Mo Lee, Seoul (KR); Ki-Chul Choi, Suwon (KR)

(73) Assignee: LG Electronics Inc., Seoul (KR)

( * ) Notice: Subject to any disclaimer, the term of this patent is extended or adjusted under 35 U.S.C. 154(b) by 85 days.

(21) Appl. No.: 10/234,328

(22) Filed: Sep. 5, 2002

(65) Prior Publication Data

US 2003/0086796 A1 May 8, 2003

(30) Foreign Application Priority Data

Nov. 5, 2001 (KR) ..... 2001-68625

(51) Int. Cl.[7] ..... F04B 17/00; F04B 17/04; F04B 35/00

(52) U.S. Cl. ..... 417/360; 417/417; 417/416; 417/902

(58) Field of Search ..... 417/360, 417, 417/416, 902

(56) References Cited

U.S. PATENT DOCUMENTS 1,934,155 A * 11/1933 Deventer ..... 417/360
2,872,101 A * 2/1959 Ryba ..... 417/417
3,788,778 A * 1/1974 Miller ..... 417/417
3,928,154 A * 12/1975 Andrews ..... 205/654
4,179,630 A * 12/1979 Stuber ..... 417/417
6,015,273 A * 1/2000 Hannagan et al. ..... 417/417
6,077,054 A * 6/2000 Lee et al. ..... 417/417
6,209,328 B1 * 4/2001 Kim et al. ..... 62/6
6,283,729 B1 * 9/2001 Makino et al. ..... 417/360
6,755,627 B2 * 6/2004 Chang ..... 417/417

FOREIGN PATENT DOCUMENTS

KR 404116 B * 11/2003 ..... 417/417

* cited by examiner

*Primary Examiner*—Cheryl J. Tyler
*Assistant Examiner*—Timothy P. Solak
(74) *Attorney, Agent, or Firm*—Birch, Stewart, Kolasch & Birch, LLP

(57) ABSTRACT

In a reciprocating compressor including a first frame for supporting a cylinder of a compressing unit, a second frame for supporting a side of an outer stator of a motor unit and a third frame for supporting the other side of the outer stator and an inner stator of the motor unit, wherein the motor unit is arranged between the second and third frames, they are combined with each other, and the assembly is combined with the first frame. Accordingly, a reciprocating compressor is capable of reducing a fabrication cost by eliminating precise processing of construction parts and simplifying an assembly process by constructing a reciprocating motor as one assembly and combining it with a compressing unit.

18 Claims, 8 Drawing Sheets

RECIPROCATING COMPRESSOR

BACKGROUND OF THE INVENTION

1. Field of the Invention

The present invention relates to a reciprocating compressor, and in particular to a reciprocating compressor which is capable of simplifying an assembly process and improving assembly strength by constructing a reciprocating motor as one assembly and combining it with a compressing unit.

2. Description of the Prior Art

In general, a compressor is classified into a rotary compressor, a reciprocating compressor and a scroll compressor, etc. according to fluid compressing methods.

The reciprocating compressor compresses a fluid by a reciprocating motion of a piston by a reciprocating motor.

FIG. 1 is a sectional view illustrating the conventional reciprocating compressor.

The conventional reciprocating compressor includes a sealed casing 106 at which a suction pipe 102 and a discharge pipe 104 are connected; a motor unit 108 disposed in the casing 106 and generating a reciprocating motion force; a compressing unit 110 receiving the reciprocating motion force from the motor unit 108 and compressing a fluid; and a supporting unit 112 for supporting the motor unit 108 and the compressing unit 110.

The motor unit 108 consists of a cylindrical outer stator 114 fixed to the supporting unit 112; an inner stator placed so as to have a certain air gap from the inner diameter of the outer stator 114; a wound coil 118 wound inside the outer stator 114 and receiving power from the outside; and a magnet 120 placed between the outer stator 114 and the inner stator 116 with a certain interval and linearly reciprocated when power is applied to the wound coil 118.

As depicted in FIG. 2, in the outer stator 114, single bodies 128 respectively fabricated by laminating a certain number of thin lamination sheets are placed in the radial direction at regular intervals.

Because the single bodies 128 are placed at regular intervals, each space portion 121 in which a combining bolt 160 passes is formed between the single bodies 128. And, each magnet 120 is fixed at the outer circumference of a magnet holder 122 at regular intervals, the magnet holder 122 is connected to the piston 124 of the compression unit 110, and the piston 124 is connected to a spring sheet member 126.

The compressing unit 110 includes the piston 124 connected to the magnet holder 122 and performing a linear reciprocating motion; a cylinder 130 receiving the piston 124 so as to slide in/out and having a certain compression space; and a suction valve 134 installed at the front of the piston 124 and opening/closing a fluid channel 132 formed at the piston 124.

As depicted in FIG. 3, the supporting unit 112 includes a first frame 140 for supporting the cylinder 130; a second frame 142 combined with the first frame 140 and supporting the side of the outer stator 114 of the motor unit 108; a third frame 144 combined with the second frame 142, supporting the other side of the outer stator 114 and supporting the inner stator 116; and the first, second, third frames 140, 142, 144 are combined with each other by the combining bolt 160.

And, a first spring 146 for providing an elastic force in receding of the piston 124 is placed between the inner side of the first frame 140 and one side of the spring sheet member 126, and a second spring 148 for providing an elastic force in proceeding of the piston 124 for the compressing operation is placed between the side of the second frame 142 and the other side of the spring sheet 126.

The first frame 140 is inserted into the outer circumference of the cylinder 130 and includes a bolt combining groove 150 formed at the second frame combining portion in the circumferential direction.

In the second frame 142, a step portion 152 being inserted into the inner circumference of the first frame 140 is formed at one side, the other side is formed as a ring shape contacted tightly to the surface of the outer stator 114. And, the second frame 142 includes bolt through hole 162 formed in the circumference direction to pass the combining bolt 160 by being connected to the bolt combining groove 150 of the first frame 140.

The third frame 144 is combined with the inner stator 116, tightly contacted to the other side of the outer stator 114 and includes a bolt through hole 164 formed in the outer circumferential direction.

The bolt combining groove 150 of the first frame 104, the bolt through hole 162 of the second frame 142 and the bolt through hole 164 of the third frame 144 are combined with each other by the combining bolt 160, and the combining bolt 160 passes the space portion 121 of the outer stator 114.

The assembly process of a supporting portion 112 of the conventional reciprocating compressor will be described.

The cylinder 130 is inserted into the inner circumference of the first frame 140, the inner stator 116 is combined with the inner circumference of the third frame 144, the step portion 152 of the second frame 142 is combined with the inner circumference of the first frame 140, and the outer stator 114 is placed between the second frame 142 and the third frame 144. And, the bolt combining groove 150 of the first frame 104, the bolt through hole 162 of the second frame 142 and the bolt through hole 164 of the third frame 144 are respectively arranged on the same straight line, and the combining bolt 160 are inserted into them and fastened.

Herein, the combining bolt 160 passes the space portion 121 of the outer stator 114.

However, in the conventional reciprocating compressor, in assembly of the supporting portion 112, because the bolt combining groove 150 of the first frame 104, the bolt through hole 162 of the second frame 142 and the bolt through hole 164 of the third frame 144 are combined with each other by the one combining bolt 160 after being arranged on the same straight line, a precise process of each construction part is required to coincide the center of the bolt combining groove 150 with the center of the bolt through holes 162, 164, and accordingly a fabrication process is increased and the assembly process is intricate.

In addition, in assembly of the first, second and third frames 140, 142, 144, because the center of the piston 124 may not coincide with the center of the cylinder 30 due to a fabrication error of each construction part, herein, abrasion of parts occurs, noise occurs in the operation, and accordingly a compression efficiency is lowered.

In addition, concentrated stress acts on the bolt through holes 150, 162, 164 of each frame by the joint force of the combining bolt 160, the holes may be damaged in the operation.

SUMMARY OF THE INVENTION

In order to solve the above-mentioned problem, it is an object of the present invention to provide a reciprocating compressor which is capable of reducing a fabrication cost by eliminating precise processing of construction parts and simplifying an assembly process by constructing a reciprocating motor as one assembly and combining it with a compressing unit.

It is another object of the present invention to provide a reciprocating compressor which is capable of simplifying an assembly process by constructing a reciprocating motor as one assembly and combining it with a compressing unit and coinciding concentricity by adjusting the concentricity of each part in assembly process.

It is yet another object of the present invention to provide a reciprocating compressor which is capable of preventing breakage of parts due to concentrated stress by reinforcing a portion at which stress is concentrated in bolt's fastening.

It is still another object of the present invention to provide a reciprocating compressor which is capable of maintaining a piston's stroke uniformly by preventing bending of a second frame due to a stress acting thereon in assembling of each frame and maintaining the concentricity between the cylinder and the piston.

In a reciprocating compressor including a first frame for supporting a cylinder of a compressing unit, a second frame for supporting a side of an outer stator of a motor unit and a third frame for supporting the other side of the outer stator and an inner stator of the motor unit, wherein the motor unit is arranged between the second and third frames, they are combined with each other by a first combining means, and the assembly is combined with the first frame by a second combining means.

The first combining means includes plural first through holes formed at the outer surface of the second frame in the circumferential direction; and plural bolt combining holes formed at the outer surface of the third frame in the circumferential direction; wherein the motor unit is arranged between the second and third frames, and they are combined with each other by plural first through bolts passing the first through holes and fastened to the bolt combining holes.

Each first combining bolt passes a space portion formed between laminated sheets of the outer stator.

The first frame includes a combining portion formed at a certain side to combine with the second frame; and plural insertion grooves formed in the circumferential direction at regular intervals to receive a bolt head of each first combining bolt.

The second combining means includes plural bolt combining grooves formed at the combining portion of the first frame in the circumferential direction at regular intervals; plural through holes formed at the outer circumference of the second frame; plural through holes formed at the outer circumference of the third frame; and second combining bolts respectively fastened between the bolt combining grooves and the through holes.

The combining portion of the first frame includes plural bolt combining grooves formed in the circumferential direction to combine with the second combining bolts respectively; and plural insertion grooves formed between the bolt combining grooves to receive a bolt head of each first combining bolt.

The second frame includes plural first through holes formed at the outer circumference to pass the first combining bolts respectively and plural second through holes formed between the first through holes to pass the second combining bolts respectively, and the third frame includes plural bolt combining holes formed at the outer circumference to receive the first combining bolts respectively and plural through holes formed between the bolt combining holes to pass the second combining bolts respectively.

A surface length of the combining portion of the first frame contacting to the second frame is greater than a width of the space portion formed between the laminated sheets of the outer stator.

The both sides of the combining portion of the first frame are greater as a certain width than the both sides of the space portion.

The reciprocating compressor further includes a position determining means formed between the first and second frames to arrange the bolt combining holes of the first frame, the second through holes of the second frame and the through holes of the third frame on the same straight line.

The position determining means includes a position determining hole formed at a certain side of the second frame; and a position determining pin installed at a certain side of the combining portion of the combining portion of the first frame, inserted into the position determining hole and arranging an assembly position of the first and second frames.

The reciprocating compressor further includes plural reinforcing portions respectively formed at the bolt through holes of the second and third frames to stand concentrated stress by the bolt's joint force.

Each reinforcing portion is formed by a burring process extending the edge of the bolt combining hole as a certain width.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a reciprocating compressor in accordance with the present invention will be described with reference to accompanying drawings.

There can be a plurality of embodiments of a reciprocating compressor in accordance with the present invention, hereinafter the preferred embodiment will be described.

Figure 1:
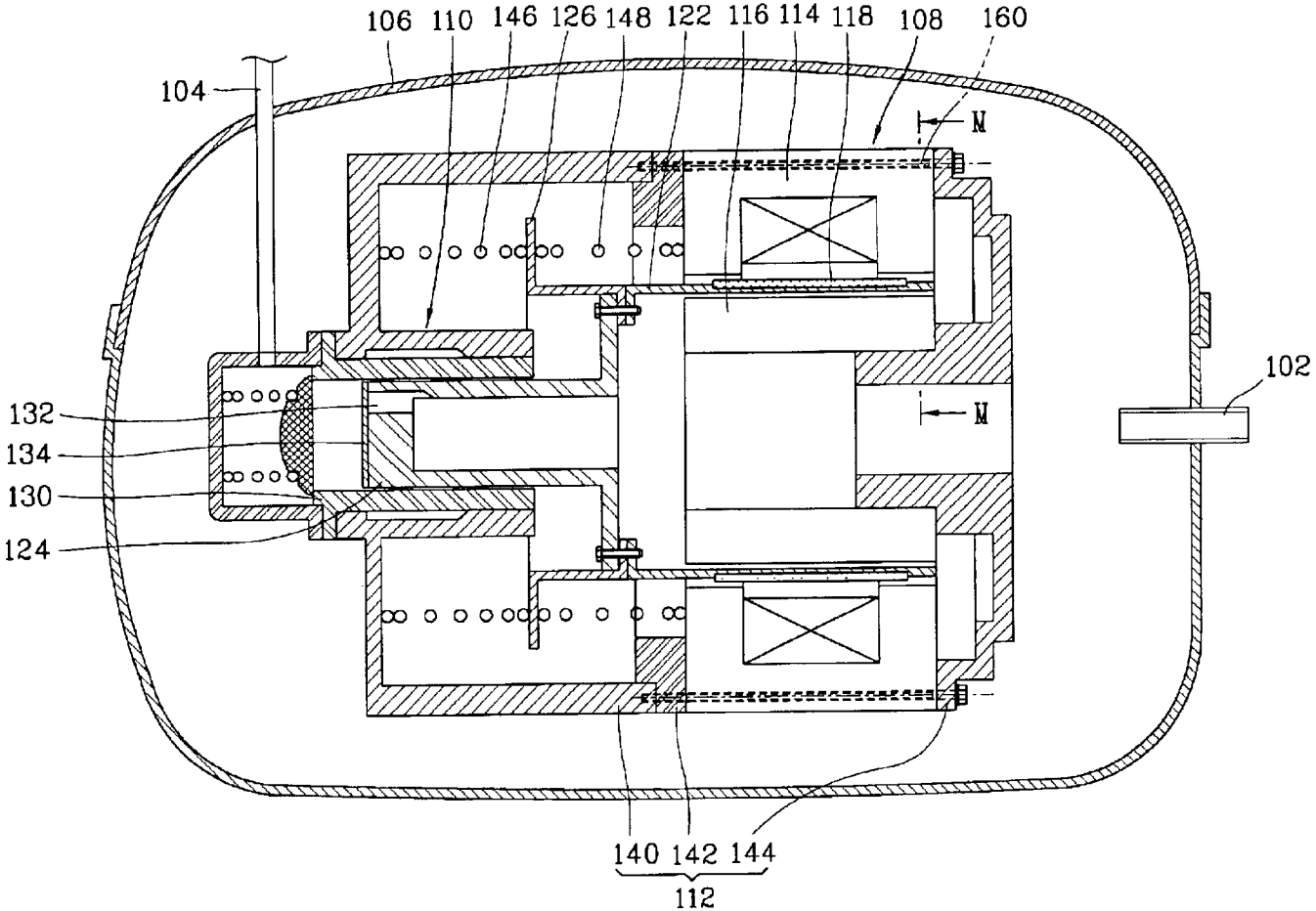
FIG. 1 CONVENTIONAL ART
FIG. 1 is a sectional view illustrating the conventional reciprocating compressor.
Figure 2:
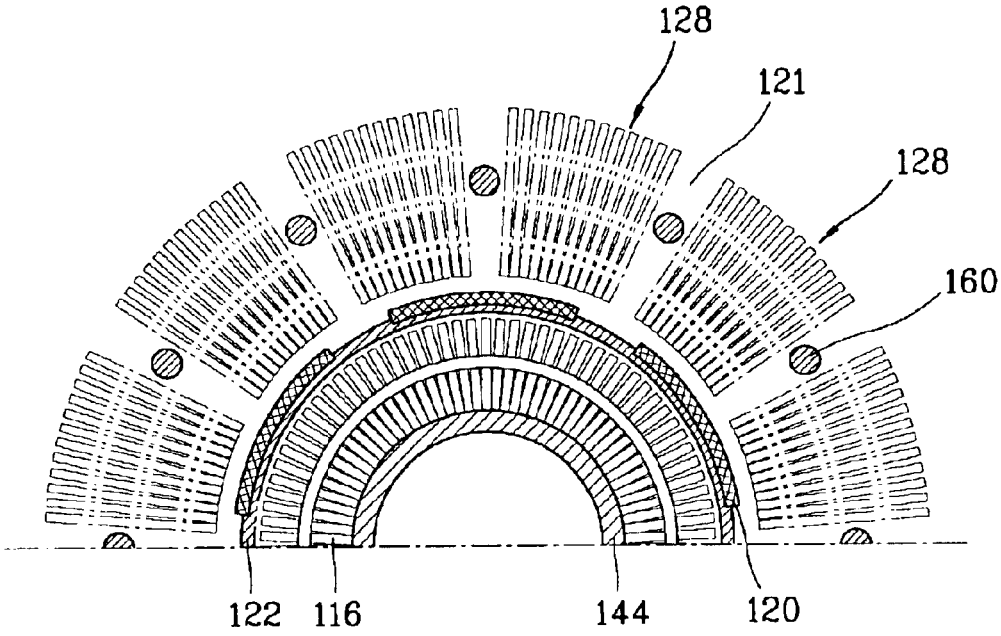
FIG. 2 CONVENTIONAL ART
FIG. 2 is a sectional view taken along a line II—II in FIG. 1.
Figure 3:
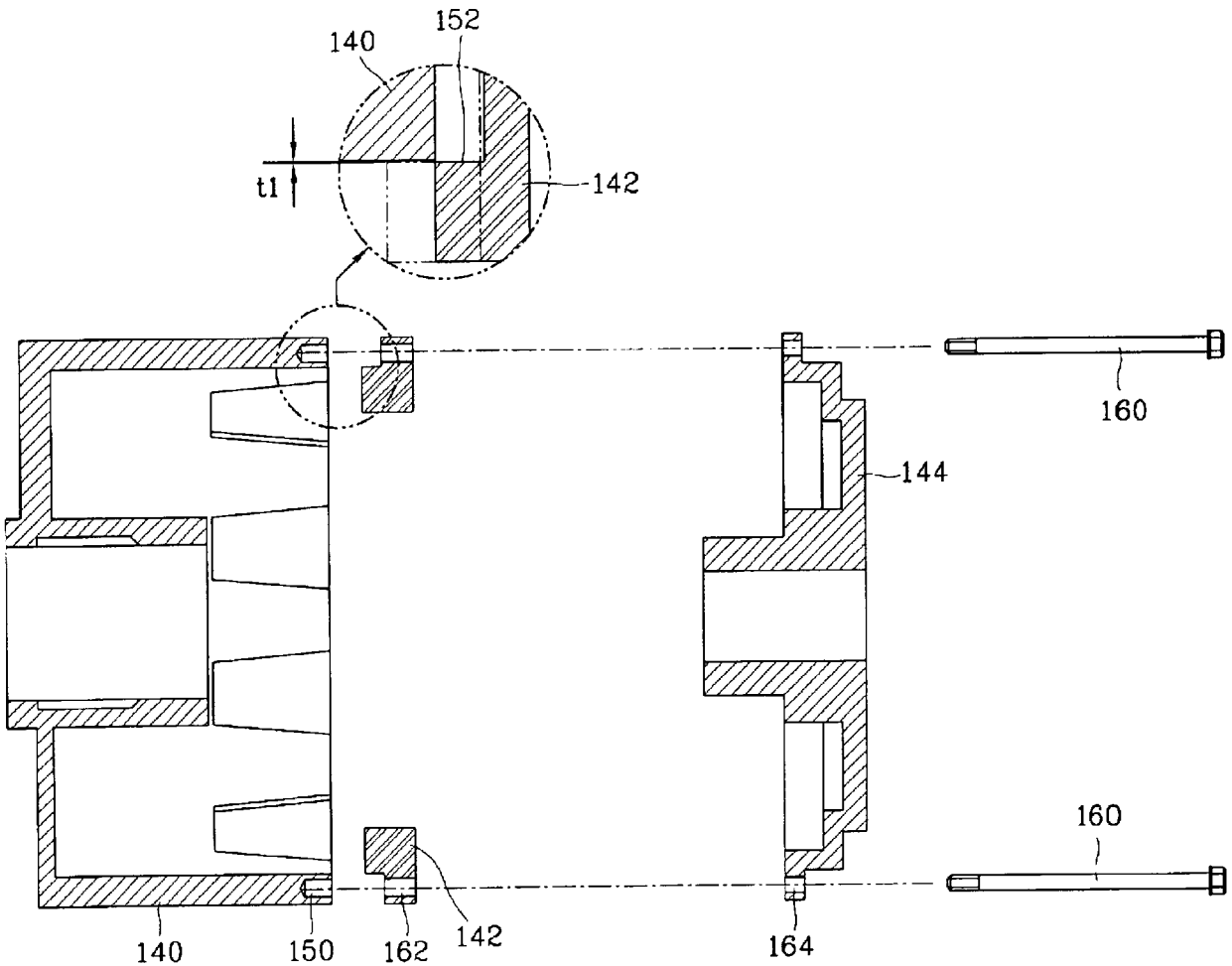
FIG. 3 CONVENTIONAL ART
FIG. 3 is an exploded sectional view illustrating a supporting unit of the conventional reciprocating compressor.
Figure 4:
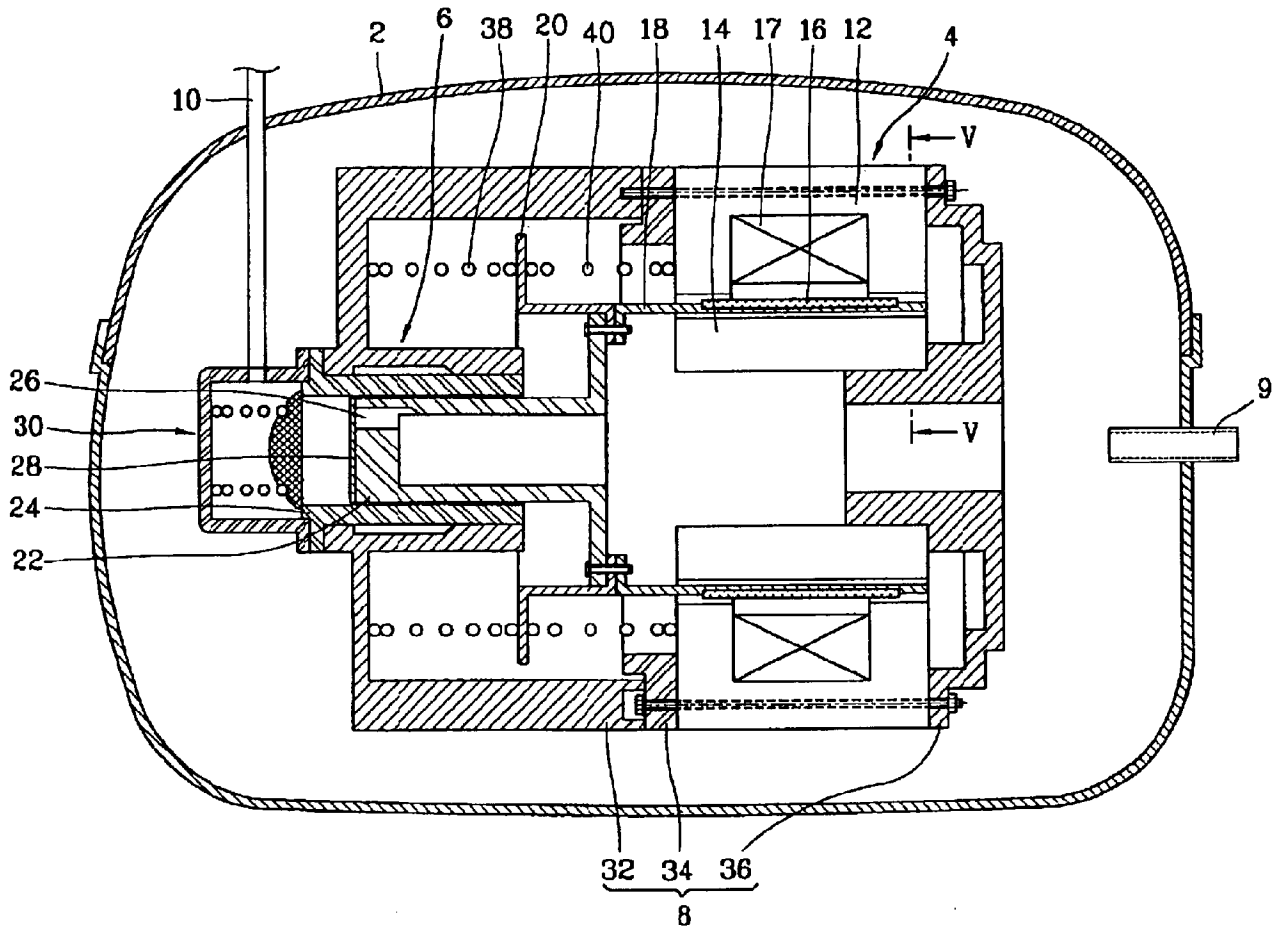
FIG. 4 is a sectional view illustrating a reciprocating compressor in accordance with the present invention.

FIG. 4 is a sectional view illustrating a reciprocating compressor in accordance with the present invention.

The reciprocating compressor in accordance with the present invention includes a sealed casing 2; a motor unit 4 disposed in the casing 2 and generating a reciprocating motion force when power is applied; a compressing unit 6 receiving the reciprocating motion force generated at the motor unit 4 and performing a compression operation of the fluid; and a supporting unit 8 for supporting the motor unit 4 and the compressing unit 6.

A suction pipe 9 for sucking the fluid and a discharge pipe 10 for discharging the compressed fluid are respectively connected to the sealed casing 2.

The motor unit 4 consists of a cylindrical outer stator 12 fixed by the supporting unit 8; an inner stator 14 placed so as to have a certain air gap from the inner circumference of the outer stator 12; a wound coil 16 wound around one of the outer stator 12 and the inner stator 14 and forming a flux between the outer stator 12 and the inner stator 14 when power is applied; and a magnet 17 placed in the air gap between the outer stator 12 and the inner stator 14 so as to be linearly reciprocated.

Figure 5:
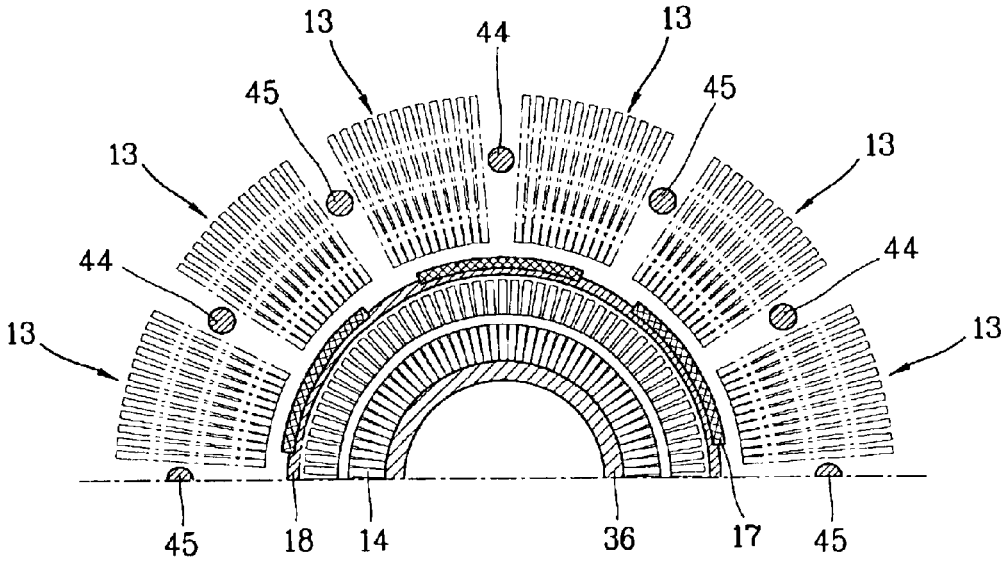
FIG. 5 is a sectional view taken along a line V—V in FIG. 4.

As depicted in FIG. 5, in the outer stator 12, single bodies 13 respectively fabricated by laminating a certain number of thin lamination sheets are radially placed at regular intervals.

Figure 6:
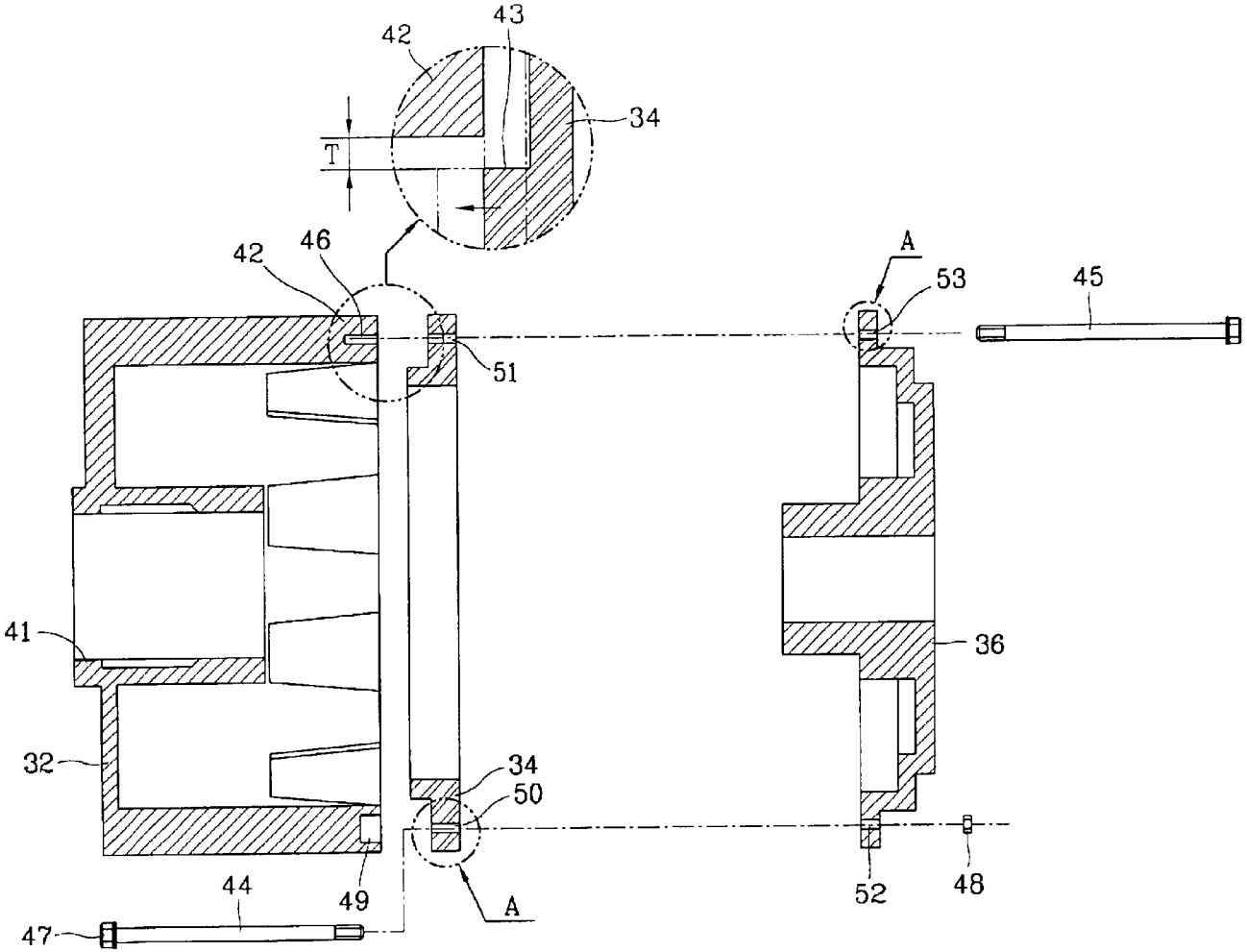
FIG. 6 is an exploded sectional view illustrating a supporting unit of the reciprocating compressor in accordance with the present invention.

Because the single bodies 13, 15 are radially placed at regular intervals, a space portion 72 in which a combining bolt 45, shown in FIG. 6, passes is formed between the single bodies 13, 15.

And, the magnet 17 is fixed to the outer circumference of a magnet holder 18 at regular intervals, and the magnet holder 18 is connected to a spring sheet member 20 and a piston 22 of the compressing unit 6.

The compressing unit 6 includes the piston 22 connected to the magnet holder 20 and performing a linear reciprocating motion; a cylinder 24 receiving the piston 22 so as to slide in/out, having a certain compression space and being supported by the supporting unit 8; a suction valve 28 installed at the front of the piston 22 and opening/closing a fluid channel 26 formed at the piston 22; and a discharge valve assembly 30 installed at the front of the cylinder 24 and opening/closing discharge of the fluid.

As depicted in FIG. 6, the supporting unit 8 includes a first frame 32 for supporting the cylinder 24; a second frame 34 combined with the first frame 32 and tightly contacted to the side of the outer stator 12; a third frame 36 combined with the second frame 34 by a first combining means, supporting the other side of the outer stator 12 and supporting the inner stator 14.

And, a first spring 38 for providing an elastic force in receding of the piston 22 after compressing is placed between the inner surface of the first frame 32 and the side of the spring sheet member 20 connected to the piston 22, and a second spring 40 for providing an elastic force in proceeding of the piston 22 for the compression is placed between the side of the second frame 34 and the other side of the spring sheet member 20.

In the first frame 32, a cylindrical unit 41 for receiving the cylinder 24 is formed at the center, and each combining portion 42 extended from the side of the cylindrical unit 41 and combined with the second frame 34 is formed. Herein, each combining portion 42 is open to combine with the second frame 34 and is formed in the circumference direction at regular intervals to circulate the fluid smoothly in/out of the first frame 32.

And, plural bolt combining grooves 46 for respectively receiving second combining bolts 45 and insertion grooves 49 for respectively receiving bolt heads 47 of first combining bolts 44 are formed at the end of the combining portion 42 of the first frame 32.

In the second frame 34 having a ring shape, a step portion 43 is formed at the side to combine with the inner circumference of the combining portion 42 of the first frame 32, plural first through holes 50 for respectively passing the first combining bolts 44 are formed in the circumferential direction, and plural second through holes 51 for passing the second combining bolts 45 are formed between the first through holes 50.

Herein, in order to insert the step portion 43 of the second frame 34 into the inner circumference of the combining portion 42, the outer diameter of the step portion 43 is a little smaller than the inner diameter of the combining portion 42 to facilitate the assembly, and accordingly there is a certain space (T) between the combining portion 42 and the step portion 43.

In more detail, as described above, after assembling the both frames 32, 34 with a certain assembly tolerance, precise adjustment is performed so as to coincide the center of the cylinder 24 with the center of the piston 22.

In the third frame 36, the inner stator 14 is inserted-assembled into the central portion, and the outer circumference is tightly contacted to the other side of the outer stator 12. Plural combining holes 52 for respectively passing the first combining bolts 44 are formed at the outside of the third frame 36 in the circumferential direction at regular intervals, and plural through holes 53 for respectively passing the second combining bolts 45 are formed between the bolt combining holes 52.

The second frame 34 and the third frame 36 support the motor unit 4, they are combined with each other by the first combining bolts 44 and are combined with the first frame 32 by the second combining bolts 45.

When each first combining bolt 44 is combined with each bolt combining hole 52 of the third frame 36 after passing each first through hole 50 of the second frame 34, the assembly of the motor unit 4 is completed. Herein, the bolt head 47 of each first combining bolt 44 is inserted into each insertion groove 49 of the first frame 32.

And, each second combining bolt 45 passes each through hole 53 of the third frame 36 and each second through hole 51 of the second frame 34, and it is combined with each bolt combining groove 46 of the first frame 32.

Each first combining bolt 44 and each second combining bolt 45 respectively passes the space portion 72 of the outer stator 12. Nut 48 is provided to secure bolt 44 to third frame 36.

Figure 7:
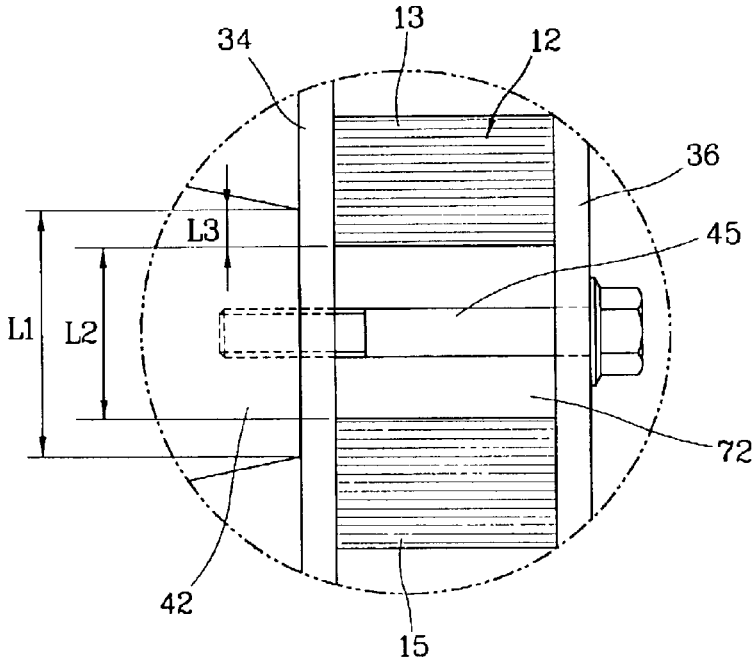
FIG. 7 is a partial-perspective view illustrating an assembly of a motor unit and the supporting unit of the reciprocating compressor in accordance with the present invention.

FIG. 7 is a front view illustrating a combining structure of the supporting unit in accordance with the present invention.

As depicted in FIG. 7, in combining each bolt with the supporting unit 8, in order to prevent the bending of the second frame 34 by a load acting on the second frame 34, a contact surface length (L1) of the combining portion 42 of the first frame 32 is longer than a width (L2) of the space portion 72 between a single bodies 13 adjacent to it of the outer stator 12.

In more detail, the contact surface length (L1) of the combining portion 42 of the first frame 32 is greater than the width (L2) of the space portion 72 of the outer stator 12, the contact surface of the combining portion 42 as a certain length (L3) is piled up on the surface of the outer stator 12, the joint force of the bolt acts between the combining portion 42 and the outer stator 12, and accordingly twisting and bending of the second frame 34 can be prevented.

Figure 8:
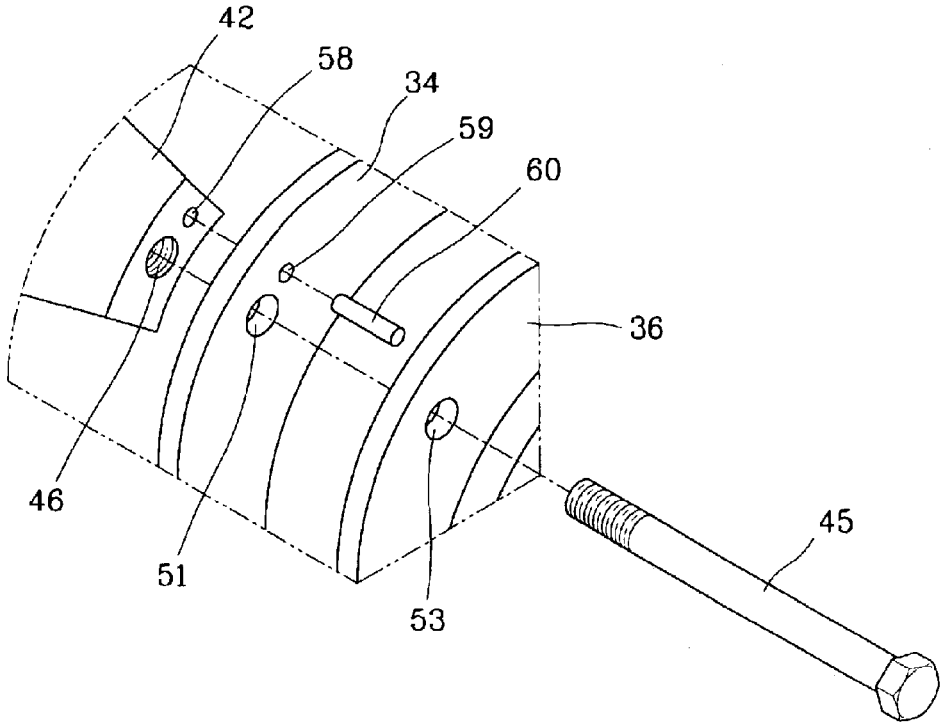
FIG. 8 is a partial-perspective view illustrating an assembly of the supporting unit of the reciprocating compressor in accordance with the present invention.

FIG. 8 is a partial-perspective view illustrating an assembly state of the supporting unit of the reciprocating compressor in accordance with the present invention.

As depicted in FIG. 8, when the first, second, third frames 32, 34, 36 are combined with each other by the second combining bolts 45, in order to arrange the bolt combining grooves 46 of the first frame 32, the second through holes 51 of the second frame 34 and the through holes 53 of the third frame 36 on the same straight line accurately, a position determining means is formed between the first, second and third frames 32, 34, 36.

The position determining means consists of a press-fit groove 58 formed at the combining portion 42 of the first frame 32, a position determining hole 59 formed at the second frame 34 and a position determining pin 60 for accurately arranging an assembly position of the first frame 32 and the second frame 34 by being pressed-fit in the press-fit groove 58 and inserted into the position determining hole 59.

As described above, the motor assembly of the second and third frames 34, 36 are combined with the first frame 32, when the position determining pin 60 pressed-fit in the press-fit groove 58 of the first frame 32 is inserted into the position determining hole 59 of the second frame 34, the bolt combining grooves 42 of the first frame 32, the bolt through holes 51, 53 of the second and third frames 34, 36 are placed on the same straight line, and accordingly the assembly process can be simplified.

Figure 9:
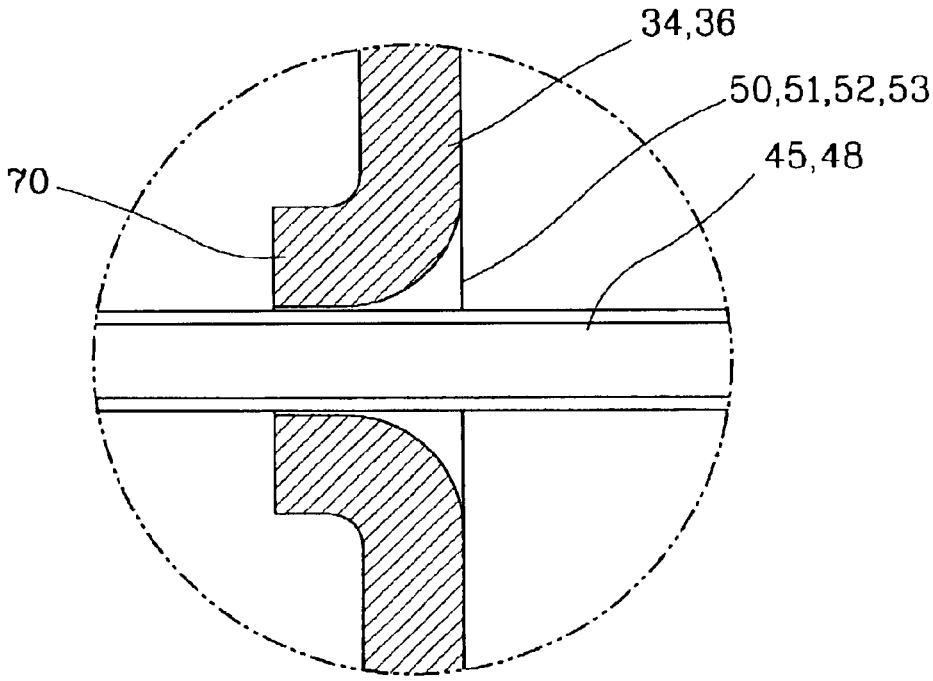
FIG. 9 is a sectional view illustrating a combining state of A portion in FIG. 6.

FIG. 9 is an enlarged sectional view of 'A' portion in FIG. 6 illustrating the combining bolt fastening state.

As depicted in FIG. 9, a concentrated stress acts on around the bolt through holes 50, 53 of the second and third frames 34, 36 by the bolt's joint force, in order to stand the concentrated stress, each reinforcing portion 70 is formed at the bolt through holes 50, 53 of the second and third frames 34, 36.

Each reinforcing portion 70 is formed by a burring process extending the edge of the bolt combining hole as a certain width to support the bolt's joint force. Besides the burring process, the reinforcing portion 70 can be constructed by various methods such as a method inserting a bushing, etc. into the bolt through hole.

The assembly of the supporting unit 8 of the reciprocating compressor in accordance with the present invention will be described in more detail.

First, the inner stator 14 is inserted into the third frame 36, and the outer stator 12 is placed at the outer circumference of the inner stator 14 with a certain air gap. Afterward, the second frame 34 and the third frame 36 are respectively placed at the both sides of the outer stator 12 and combined with each other by a first combining means.

In more detail, the first through holes 50 of the second frame 34 and the bolt combining holes 52 of the third frame 36 are respectively placed on the same straight line, the first combining bolts 44 respectively pass the first through holes 50 and are fastened to the bolt combining holes, and accordingly the assembly of the motor unit 4 is completed.

In that state, the cylinder 24 is inserted into the inner circumference of the first frame 32, the step portion 43 of the second frame 34 is inserted into the inner circumference of the combining portion 42 of the first frame 32. Herein, when the position determining pin 60 pressed-fit in the first frame 32 is inserted into the position determining hole 59 of the second frame 34, the bolt combining grooves 42 of the first frame 32, the second through holes 51 of the second frame 34 and the through holes 53 of the third frame 36 are respectively placed on the same straight line, the second combining bolts 45 pass the through holes 51, 53 and are fastened to the bolt combining grooves 46 respectively, and accordingly the assembly is completed.

Advantages of the reciprocating compressor in accordance with the present invention will be described.

By placing a motor unit between a second frame and a third frame, combining them as one assembly unit (motor unit) by using first combining bolts and combining it with the first frame by using second combining bolts, the assembly process can be simplified. In addition, because it does not require extreme precise processing of each construction part, a fabrication cost can be reduced.

In addition, by constructing a position determining means at the side of the first, second and third frames, it is possible to arrange accurately a position of the bolt combining holes in assembly of each frame, and accordingly assembly can be facilitated and reliability of assembly process can be improved.

In addition, by placing the both sides of the combining portion of the first frame so as to overlap as a certain width with the outer stator placed on an air gap, it is possible to prevent the twisting or bending of the second frame by the joint force of the bolt, and accordingly the center of the cylinder can easily coincide with the center of the piston and the stroke of the piston can be maintained uniformly.

In addition, by forming reinforcing portions around through holes passing bolts of the second and third frames, it is possible to prevent the deformation of the through holes due to the bolt's joint force.

What is claimed is:

1. In a reciprocating compressor including a first frame for supporting a cylinder of a compressing unit, a second frame for supporting a side of an outer stator of a motor unit and a third frame for supporting the other side of the outer stator and an inner stator of the motor unit, wherein the motor unit is arranged between the second and third frames, the second and third frames are combined with each other by a first combining means, and the assembly of the motor unit and the second and third frames is combined with the first frame by a second combining means; and wherein the second frame has an outer flange extending away from the cylinder and plural first through holes are located in the outer flange of the second frame in the circumferential direction; and plural bolt combining holes formed at an outer surface of the third frame in the circumferential direction; and wherein the motor unit is arranged between the second and third frames and the first combining means comprises first through bolts passing the first through holes and fastened to the bolt combining holes.

2. The compressor of claim 1, wherein each first through bolt passes a space portion formed between the single bodies of the outer stator.

3. The compressor of claim 1, wherein the first frame includes:

a combining portion formed at a side of the first frame to combine with the second frame; and plural insertion grooves formed in the circumferential direction at regular intervals to receive a bolt head of each first combining bolt.

4. The compressor of claim 1, further comprising:

plural reinforcing portions respectively formed at the bolt through holes of the second and third frames to stand concentrated stress by the bolt's joint force.

5. The compressor of claim 4, wherein each reinforcing portion is formed by a burring process extending the edge of the bolt combining hole as a certain width.

6. In a reciprocating compressor including a first frame for supporting a cylinder of a compressing unit, a second frame for supporting a side of an outer stator of a motor unit and a third frame for supporting the other side of the outer stator and an inner stator of the motor unit, wherein the motor unit is arranged between the second and third frames, the second and third frames are combined with each other by a first combining means, and the assembly of the motor unit and the second and third frames is combined with the first frame by a second combining means; and wherein the second combining means includes:

plural bolt combining grooves formed at the combining portion of the first frame in the circumferential direction at regular intervals;

plural through holes formed at the outer circumference of the second frame;

plural through holes formed at the outer circumference of the third frame; and second combining bolts respectively fastened between the bolt combining grooves and the through holes.

7. The compressor of claim 6, wherein the combining portion of the first frame includes:

plural bolt combining grooves formed in the circumferential direction to combine with the second combining bolts respectively; and plural insertion grooves formed between the bolt combining grooves to receive a bolt head of each first combining bolt.

8. The compressor of claim 6, wherein the second frame includes plural first through holes formed at the outer circumference to pass the first combining bolts respectively and plural second through holes formed between the first through holes to pass the second combining bolts respectively, and the third frame includes plural bolt combining holes formed at the outer circumference to receive the first combining bolts respectively and plural through holes formed between the bolt combining holes to pass the second combining bolts respectively.

9. The compressor of claim 6, wherein a surface length of the combining portion of the first frame contacting to the second frame is greater than a width of the space portion formed between the single bodies of the outer stator.

10. The compressor of claim 9, wherein the both sides of the combining portion of the first frame are greater as a certain width than the both sides of the space portion.

11. The compressor of claim 6, further comprising:

a position determining means formed between the first and second frames to arrange the bolt combining holes of the first frame, the second through holes of the second frame and the through holes of the third frame on the same straight line.

12. The compressor of claim 11, wherein the position determining means includes:

a position determining hole formed at a certain side of the second frame; and a position determining pin installed at a certain side of the combining portion of the combining portion of the first frame, inserted into the position determining hole and arranging an assembly position of the first and second frames.

13. In a reciprocating compressor including a first frame for supporting a cylinder of a compressing unit compressing a fluid, a second frame combined with combining portions of the first frame and supporting a side of an outer stator of a motor unit generating a reciprocating motion and a third frame combined with the second frame and supporting the other side of the outer stator of the motor unit, wherein a surface length of the combining portion of the first frame contacted to the second frame is greater than a width of a space portion between adjacent single bodies of the outer stator for passing a combining bolt.

14. The compressor of claim 13, wherein each combining portion of the first frame is formed at the side of the first frame in the circumferential direction at regular intervals, and the both sides of each combining portion contacted to the second frame are greater as a certain width than the space portion of the outer stator.

15. In a reciprocating compressor including a first frame for supporting a cylinder of a compressing unit for compressing a fluid, a second frame combined with combining portions of the first frame and supporting a side of an outer stator of a motor unit generating a reciprocating motion and a third frame combined with the second frame and supporting the other side of the outer stator of the motor unit, a reciprocating compressor, comprising:

position determining means formed between at least two frames to arrange a combining position of the first frame, the second frame and the third frame.

16. The compressor of claim 15, wherein the position determining means includes:

a position determining pin projected from one of the first, the second and the third frames; and a position determining hole for receiving the position determining pin formed at least one frame between two frames except the frame having the position determining pin.

17. In a reciprocating compressor including a first frame for supporting a cylinder of a compressing unit for compressing a fluid, a second frame combined with combining portions of the first frame and supporting a side of an outer stator of a motor unit generating a reciprocating motion and a third frame combined with the second frame and supporting the other side of the outer stator of the motor unit and combining bolts for fixing the frames by being combined with bolt through holes formed at the first, second and third frames, a reciprocating compressor, comprising:

plural reinforcing portions formed at the bolt through holes of the frames to stand concentrated stress by the joint force of the combining bolts.

18. The compressor of claim 17, wherein each reinforcing portion is formed by a burring process extending the edge of each bolt combining hole as a certain width.

* * * * *